US011033135B2

(12) United States Patent
Rayne

(10) Patent No.: US 11,033,135 B2
(45) Date of Patent: Jun. 15, 2021

(54) APPARATUS FOR ASSISTING WITH THE APPLICATION OF A GARMENT

(71) Applicant: Damian Rayne, London (GB)

(72) Inventor: Damian Rayne, London (GB)

( * ) Notice: Subject to any disclaimer, the term of this patent is extended or adjusted under 35 U.S.C. 154(b) by 67 days.

(21) Appl. No.: 15/571,805

(22) PCT Filed: Apr. 26, 2016

(86) PCT No.: PCT/GB2016/051177
§ 371 (c)(1),
(2) Date: Jan. 24, 2018

(87) PCT Pub. No.: WO2016/177995
PCT Pub. Date: Nov. 10, 2016

(65) Prior Publication Data

US 2018/0360249 A1 Dec. 20, 2018

(30) Foreign Application Priority Data

May 6, 2015 (GB) ..... 1507735

(51) Int. Cl.
*A47G 25/90* (2006.01)

(52) U.S. Cl.
CPC ..... *A47G 25/905* (2013.01)

(58) Field of Classification Search
CPC .... A47G 25/905; A47G 25/907; A47G 25/90; A47G 25/904; A47G 25/908
USPC ..... 223/111, 112, 113, 114
See application file for complete search history.

(56) References Cited

U.S. PATENT DOCUMENTS

| | | | | |
|---|---|---|---|---|
| 1,315,096 A | | 9/1919 | Deiley | |
| 2,828,057 A | * | 3/1958 | MacLauchlan | A47G 25/905 223/111 |
| 3,727,812 A | | 4/1973 | Weiss | |
| 4,260,083 A | * | 4/1981 | Aslin | A47G 25/905 223/111 |
| 4,651,909 A | * | 3/1987 | Banting | A47G 25/905 223/111 |

(Continued)

FOREIGN PATENT DOCUMENTS

| | | |
|---|---|---|
| EP | 1674005 | 6/2006 |
| EP | 1790258 | 5/2007 |
| WO | 99/038424 | 8/1999 |

OTHER PUBLICATIONS

International Search Report and Written Opinion for PCT/GB2016/051177, dated Jul. 21, 2016.
UK Search Report for GB1507735.7, dated Oct. 24, 206.

*Primary Examiner* — Nathan E Durham
(74) *Attorney, Agent, or Firm* — Dorsey & Whitney LLP

(57) ABSTRACT

An apparatus for assisting with the application of a garment. The apparatus may be embodied as an apparatus for assisting with the application of a tubular garment, such as a bandage or sock, including compression bandages, compression socks, support bandages and support socks, or may be embodied as a tubular garment application tool. The apparatus comprises two substantially parallel spaced-apart elongate arms and is reconfigurable between a first configuration in which the elongate arms are substantially coplanar and a second configuration in which the elongate arms substantially oppose, or at least partly face, each other.

42 Claims, 5 Drawing Sheets

(56) References Cited

U.S. PATENT DOCUMENTS 4,991,757 A * 2/1991 Deakyne ..... A47G 25/905 223/111
5,249,720 A 5/1993 White
5,741,569 A * 4/1998 Votino ..... A47G 25/82 223/111
5,799,844 A * 9/1998 James ..... A47G 25/905 223/111
5,909,831 A 6/1999 Griffin
6,032,839 A * 3/2000 Joosten ..... A47G 25/907 223/111
6,056,171 A * 5/2000 Santamaria ..... A47G 25/905 223/111
6,234,370 B1 5/2001 Kummerle et al.
6,426,132 B1 * 7/2002 Stewart ..... A47G 25/82 223/118
7,234,616 B2 * 6/2007 Thom ..... A47G 25/905 223/1
8,393,503 B2 * 3/2013 Moscato ..... A47G 25/905 223/112
8,418,896 B1 4/2013 Higa
8,919,620 B2 * 12/2014 Taylor ..... A47G 25/905 223/111
9,144,339 B2 * 9/2015 Cannata ..... A47G 25/82
2007/0062986 A1 3/2007 Doud
2008/0277431 A1 * 11/2008 Lun ..... A47G 25/907 223/111
2010/0200623 A1 * 8/2010 Higuchi ..... A47G 25/905 223/111
2011/0042425 A1 * 2/2011 Norris ..... A47G 25/905 223/112
2011/0049201 A1 * 3/2011 Bertinotti ..... A47G 25/905 223/112
2012/0187159 A1 * 7/2012 Joosten ..... A47G 25/80 223/111
2012/0228343 A1 * 9/2012 Brobeg ..... A47G 25/905 223/111
2013/0214016 A1 * 8/2013 Carbray ..... A47G 25/90 223/111
2014/0151412 A1 * 6/2014 Cohen ..... A47G 25/905 223/111
2015/0136815 A1 * 5/2015 Clifton ..... A47G 25/905 223/112

* cited by examiner

A
22
24
25
26
23
32
33
22
31
16
6
21
2
20
12
18
19
11
14
13
3
29
28
5
103
2A
2A
30
27
15
5

8
14
13
3
29
28
5
105
105
30
27
15
5

5
103

APPARATUS FOR ASSISTING WITH THE APPLICATION OF A GARMENT

CROSS-REFERENCE TO RELATED APPLICATIONS

This application is a national stage application of International Application No. PCT/GB2016/051177, filed Apr. 26, 2016, and entitled "AN APPARATUS FOR ASSISTING WITH THE APPLICATION OF A GARMENT", which claims priority to GB Application No. 1507735.7, filed May 6, 2015, both of which are hereby incorporated by reference herein in their entireties for all purposes.

TECHNICAL FIELD

The present disclosure generally relates to an apparatus for assisting with the application of a garment and more particularly to an apparatus for assisting with the application of a tubular garment, such as a bandage or sock, including compression bandages, compression socks, support bandages and support socks, or may be embodied as a tubular garment application tool.

BACKGROUND

Tubular garments, such as socks and stockings, are worn by people of all ages and of various physical abilities. Some wearers of tubular garments have great difficulty in applying the garments, particularly if their physical abilities are impaired, for example if the wearer suffers from restricted mobility or flexibility. This is because many tubular garments are intended to be worn on the limbs of a wearer and so can require a great deal of flexibility and coordination in order for the wearer to apply the tubular garment to their leg or arm, particularly in the case of socks or stockings which require that a wearer is able to reach their feet in order for the user to put them on. The application of socks or stockings can therefore be particularly difficult for those persons with restricted mobility or who are otherwise unable to bend either their back or legs or move their arms sufficiently in order to reach their feet.

Furthermore, tubular garments are inherently difficult to apply as the material of the garment has a tendency to roll and bunch up when being applied, particularly when the garment is tight-fitting or elasticated such as compression bandages or support bandages. In the case of tight-fitting or elasticated garments, when the material bunches up, the garment becomes even more difficult to apply as the bunched up material produces a local band of increased compression, causing the garment to become even more likely to bunch up further.

Compression socks, stockings and bandages have been found to be particularly useful in Medicine where they have found a number of applications and are frequently used to reduce swelling, to treat varicose veins and deep vein thrombosis, and in order to assist with the recovery of a patient from operations such as knee surgery. Therefore, people who have limited physical ability, and so may have greater difficulty in applying compression bandages, are among those who may benefit the most from the use of compression bandages.

A known sock puller, as described in U.S. Pat. No. 1,315,096, comprises moveable sock supporters connected to pivotable struts which may be moved to separate the sock supports in order to expand a sock. The device further comprises a clamp and finger-actuated ring pulls for actuating the clamp. Such devices are highly complex and cumbersome, and require a large number of movable parts which may seize, snag or otherwise get caught up in the clothing or the user. Devices such as these are also unable to conform or adapt to the particular size or shape or the user, particularly if the user is wearing a cast on a part of their leg such that the proportions of a length of their leg are much greater than the normal proportions of a leg or greater than other parts of their leg. For such devices, differently sized versions must therefore be provided according to the particular size of the user. Furthermore, such devices are also visually unappealing.

A known device for putting on hosiery, as described in WO 99/38424, comprises a wire frame comprising two receiving parts which can be spread apart by the action of a drive unit. Such a device requires a power supply to operate and may appear dangerous or uninviting to a user. Because such devices are to be used on a floor, they also require that the user is able to step into the device. Consequently, these devices cannot be used for people who are bed bound and are used with great difficulty by people who are unable to stand or who are wheelchair bound. Such devices are also very expensive and difficult to manufacture, and are also difficult to store as they are tall and cannot be stacked together. Such devices are also difficult to transport and so may incur high packaging and shipping costs. These devices can also be difficult or impossible to store in a hospital or physiotherapist's office for example in the numbers that would be need to be stored there due to the often limited amount of space available in such places.

SUMMARY

One or more embodiments of the present invention aims to alleviate, at least to a certain extent, the problems and/or address at least to a certain extent the difficulties associated with the prior art.

According to an embodiment of the present invention, there is provided an apparatus for assisting with the application of a garment, the apparatus comprising a garment supporting means configured to support a garment, the garment supporting means comprising two substantially parallel and spaced-apart sheet-like elongate arms, the apparatus being reconfigurable between a first configuration in which the elongate arms are substantially coplanar and a second configuration in which the elongate arms substantially oppose, or at least partly face, each other. Such an arrangement enables the apparatus to be reconfigured from a substantially flat or planar configuration into a three dimensional arrangement so that it may receive a compression sock or bandage and to enable the compression sock or bandage to be expanded along a portion of the length of the elongate arms. An apparatus according to this embodiment of the present invention is therefore able to be easily stowed away when not in use.

Optionally, the apparatus further comprises rotation means configured to enable the elongate arms to be rotatable about an axis substantially parallel to the longitudinal axis of elongate arms. Such an arrangement enables a compression sock or bandage to be expanded along a significant portion of its length and also enable the apparatus to be placed around a limb of a user and for the apparatus to adapt to size of the user's limb. Two rotatable elongate arms are therefore particularly advantageous in the application of longer tubular garments such as knee-length or leg-length compression socks.

Optionally, the rotation means is configured to enable the elongate arms to be rotatable about an axis substantially parallel to the longitudinal axis of elongate arms. The elongate arms being rotatable about an axis substantially parallel to the longitudinal axis of the elongate arms, such as a central longitudinal axis of the apparatus, enable the elongate arms to be expanded away from a user's limb, such as their leg or arm, in order to accommodate the particular size of the user's limb and also to enable the tubular garment to be expanded along its length after it has been applied to the elongate arm. This also assists in removing the apparatus from the user's limb.

Optionally, the apparatus further comprises a sheet of material wherein the sheet of material comprises the garment supporting means. When a sheet of material comprises the garment supporting means, the two elongate arms are part of the same sheet of material.

Optionally, the sheet of material is substantially flat. A substantially flat sheet of material enables the apparatus to be substantially flat at rest, i.e. when the apparatus is not being bent out of plane by a user. This enables the apparatus to be more easily stowed away or stacked and may additionally reduce shipping and packaging costs.

Optionally, the rotation means comprises a flexible bridging means configured to adjoin the two elongate arms. A flexible bridging means extending between the two elongate arms and connecting them together enables the two elongate arms to be flexibly joined together so that the flexible bridging means may be bent or flexed such that the elongate arms may rotate with respect to each other, substantially about a central longitudinal axis of the apparatus which is substantially parallel to and equidistant from the elongate arms. The flexible bridging means also enables the elongate arms to be equidistance from each other along their entire length when the flexible bridging means is flexed or bent.

Optionally, the sheet of material comprises a flexible bridging means configured to adjoin the two elongate arms. The flexible bridging means and two elongated arms being manufactured from the same sheet of material is advantageous in reducing manufacturing costs and improving the simplicity and usability of the apparatus. The flexible bridging means may also be configured to enable the apparatus to lie substantially flat or be substantially planar when it is not being flexed or bent out of plane by a user.

Optionally, the flexible bridging means is configured such that, when the apparatus is flexed about its longitudinal axis, the bridging means extends radially outwards with respect to the longitudinal axes of the elongate arms. By the flexible bridging means extending radially outwards when the apparatus is bent or flexed, the flexible bridging means provides a raised platform, raised with respect to the elongate arms, in order to provide additional clearance between the garment and the user when the garment is pulled on top of the flexible bridging means.

Optionally, the apparatus is bendable, for example from the first configuration e.g. to the second configuration.

Optionally, the sheet of material comprises acrylic or polycarbonate.

Optionally, the apparatus is formed from a single sheet of material, the single sheet optionally being flat or substantially flat when the apparatus is in the first configuration. The apparatus being formed from a single sheet of material is advantageous in improving the simplicity and usability of the apparatus, as well as reducing manufacturing costs. The apparatus can therefore be cut from a single, flat or planar sheet of material. The apparatus is therefore also able to lie substantially flat when not in use for ease of storage or during shipping.

Optionally, the elongate arms and the rotation means together comprise a single sheet of material.

Optionally, the apparatus includes cushioning means configured to cushion a user from the garment supporting means. A cushioning means may be applied or attached to the apparatus, for example to the garment supporting means or elongate arms, in order to improve the comfort of the user so that their body does not catch or rub against the main body of the apparatus.

Optionally, the cushioning means is configured to be detachable from a further component of the garment supporting means, which is optionally layer-like. A detachable cushioning means enables the cushioning means to be removed if it is not needed or in order to wash or clean, or replace the cushioning means.

Optionally, the cushioning means includes a foam layer. The cushioning means may comprise a foam layer applied, attached, adhered or bonded to the main layer or body of the apparatus. In this regard, medium density foam has been found to be particularly advantageous. Alternatively or additionally, the cushioning means may comprise a rubber layer.

Optionally, the foam layer comprises a medium density foam.

Optionally, the foam layer comprises a high density foam.

Optionally, the cushioning means comprises a friction-reducing layer or film. A friction-reducing layer or film applied to the cushioning means ensures that the apparatus may be easily applied to and removed from a user without the apparatus catching or rubbing on the user or on their clothing.

Optionally, the friction-reducing layer or film is a vinyl layer or film.

Optionally, the apparatus further comprises apparatus guiding means 105 configured to enable the apparatus to be guided, in use, along a limb of a user. Thus, the apparatus may enable the apparatus to be more easily and readily applied to a user and without causing the user undue harm, pain or distress. The guiding means may be pre-formed into the main layer or sheet of material of the apparatus or it may be part of the cushioning means. Preferably the guiding means is located on the interior surface, also referred to as the inner surface or the underside, of the apparatus.

Optionally, the apparatus guiding means comprises spaced apart guides configured to receive a portion of a user's limb and configured to enable the portion of the user's limb to be slid between the guides. The guiding means may therefore act as rails in order to locate the user's limb with respect to the apparatus in order to ensure the apparatus is applied correctly and in the correct direction or combination or series of directions.

Optionally, the apparatus further comprises length adjusting means configured to enable the length of at least one elongate arm to be varied. Length adjusting means enable the apparatus to be extended and this is particularly advantageous in order to accommodate a particularly long limb of a user or a particularly long tubular garment. For example, the apparatus may be sized for the application of a tubular garment onto an arm, but length adjusting means enable the same apparatus to be used also for the application of a tubular garment on a leg.

Optionally, the length adjusting means comprises an extension piece configured to extend from an end of at least one of the elongate arms. An extension piece provides a convenient means of extending one or both of the elongate arms so that the apparatus may be used with or without the extension piece engaged.

Optionally, the extension piece is detachably attachable to an end of one of the elongate arms. A detachable extension piece enables the extension piece to be removed when it is not required and so the same apparatus can be used for a variety of differently sized limbs or garments.

Optionally, when the apparatus is in the first configuration, the arcuate elongate arms curve substantially towards each other and, optionally, have substantially the same curvature as each other. In this way, when the apparatus is flexed or bent about a central longitudinal axis, the tips of the elongate arms point substantially in the same direction and so provide a garment spanning means such that the garment is lifted away from the user's limb and spans across a length of the elongate arms in order to increase the clearance between the garment and the user.

Optionally, a tip of each elongate arm is configured to curve towards a tip of the other elongate arm such that the elongate arms become closer together towards the tips. Such a feature enables a number of differently sized garments or both tighter and looser garments to be used on the same apparatus while the apparatus is in the flexed configuration.

Optionally, the apparatus further comprises a garment retaining means. A garment retaining means enables a garment to be retained on the apparatus in order to facilitate the application of the garment to the user. The elongate arms or flexible bridging member, or any other part of the apparatus, may comprise the garment retaining means. The garment retaining means enables the user to operate the apparatus without having to manually hold the garment onto the apparatus.

Optionally, the garment retaining means comprises a friction-increasing means configured, in use, to increase the friction between the garment retaining means and a garment. A friction-increasing means provides a simple and effective means of retaining the garment on the outer surface of the apparatus. Friction increasing means is particularly advantageous as it may take advantage of the woven nature or other physical properties of the material of the garment and may be configured to engage with the fibres of the garment.

Optionally, the friction-increasing means comprises a friction surface having an increased coefficient of friction with respect to a surface adjacent thereto or surrounding the same. A localised area of increased friction enables the garment to be retained on the apparatus when it engages the area of increased friction, but also enables the garment to be easily removed by simply removing the garment from the localised area of increased friction after which the garment may more easily slide off of the apparatus.

Optionally, the friction surface comprises a hooked portion of a hook and loop fastening system. Hook and loop fastening systems, commonly referred to as Velcro, are inexpensive and widely available and are particularly beneficial for engaging with the fibres of the garment for providing a secure but easily detachable means of retaining a garment on the apparatus.

Optionally, the garment retaining means includes a plurality of protrusions extending from the surface of the garment retaining means, the protrusions being configured to engage a garment. Such protrusions may be sized specifically to engage with the spaces of the weave of the garment or may be sized specifically according to the thickness of the garment's fibres. Such protrusions may be shaped like a shark tooth or a thorn and may have rounded tips. The protrusions may be perpendicular to the surface of the apparatus or may be raised at an acute angle from outer surface of the apparatus. The protrusions may point away from the tip or ends of the elongated arms and towards the end of the apparatus comprising the handles.

Optionally, the garment retaining means includes a garment receiving recess configured to receive a garment in use and to retain the garment. A garment receiving recess may be a recess or groove in the surface of the apparatus or may be a recess or notch in the peripheral edge of the apparatus, for example in the sheet of material of the apparatus.

Optionally, the garment receiving recess is configured such that, when the apparatus is in the second configuration, the garment receiving recess provides a reduced circumference of an outer surface of the apparatus with respect to a circumference of an adjacent surface of the apparatus. A reduced circumference in the flexed configuration provides that a garment, particularly an elasticated garment, when stretched will naturally be held in the recess simply by the compression provided by the stretching of the garment. This feature therefore provides a simple and elegant means of retaining the garment on the apparatus.

Optionally, the garment receiving recess is substantially V-shaped. A V-shaped recess provides a precise and definite minimum circumference so that the garment will naturally lie at the tip of the V-shape and further serves as an indication means to indicate to the user how far the garment should be pulled up the apparatus.

Optionally, the elongate arms include the garment retaining means. As the elongate arms form part of the garment supporting means, they are particularly suited for comprising garment retaining means.

Optionally, the apparatus includes a fastening means for fastening the apparatus against a limb of the user. A fastening means ensures that the apparatus maintains its shape while in use when the apparatus is applied to a user's limb and prevents the apparatus from assuming the flat configuration (i.e. not the flexed configuration). A fastening means further serves to secure the apparatus to the user's limb to assist in maintaining the proper location of the apparatus with respect to the user's limb.

Optionally, the fastening means comprises a strap.

Optionally, the strap comprises a hook and loop fastener. Hook and loop fasteners are inexpensive and widely available and are particularly suited in use with a strap to provide an easy means of securing and readily undoing the fastening means.

Optionally, the apparatus includes two spaced apart handles, located on either side of the apparatus. Handles provide means of enabling the user to properly grasp the apparatus so that it may be correctly used. Handles located on either or opposite sides or the apparatus, spaced away from the central longitudinal axis of the apparatus, enable a user to more easily bend the apparatus out of plane from the flat configuration to the flexed configuration.

Optionally, each handle comprises an aperture configured to receive fingers of the user. Apertures may be cut into the apparatus to provide means of receiving the hand or fingers of the user. Apertures are particularly advantageous as they efficiently transfer the pulling force of the user to the body of the apparatus and cannot snap-off or become otherwise damaged as some external handles might.

Optionally, at least one of the elongate arms, with the apparatus in the second configuration, is substantially arcuate such that it is curved about a lateral axis thereof. The curvature of the elongate arms about a lateral axis of the elongate arm provides additional clearance between the garment and the user.

Optionally, the apparatus comprises a tubular garment application tool.

Optionally, the apparatus comprises a compression bandage application tool.

According to an embodiment of the present invention, there is provided a method of manufacturing an apparatus for assisting with the application of a garment, comprising the step of manufacturing from a single sheet of material an apparatus according to claim 1.

Optionally, the method includes forming at least the elongate arms together from a single sheet of material.

According to an embodiment of the present invention, there is provided an apparatus for assisting with the application of a garment substantially as described herein with reference to the accompanying drawings.

BRIEF DESCRIPTION OF THE DRAWINGS

The present invention may be carried out in various ways and one or more embodiments of an apparatus for assisting with the application of a garment will now be described by way of example with reference to the accompanying drawings, in which.

DETAILED DESCRIPTION

Figure 1:
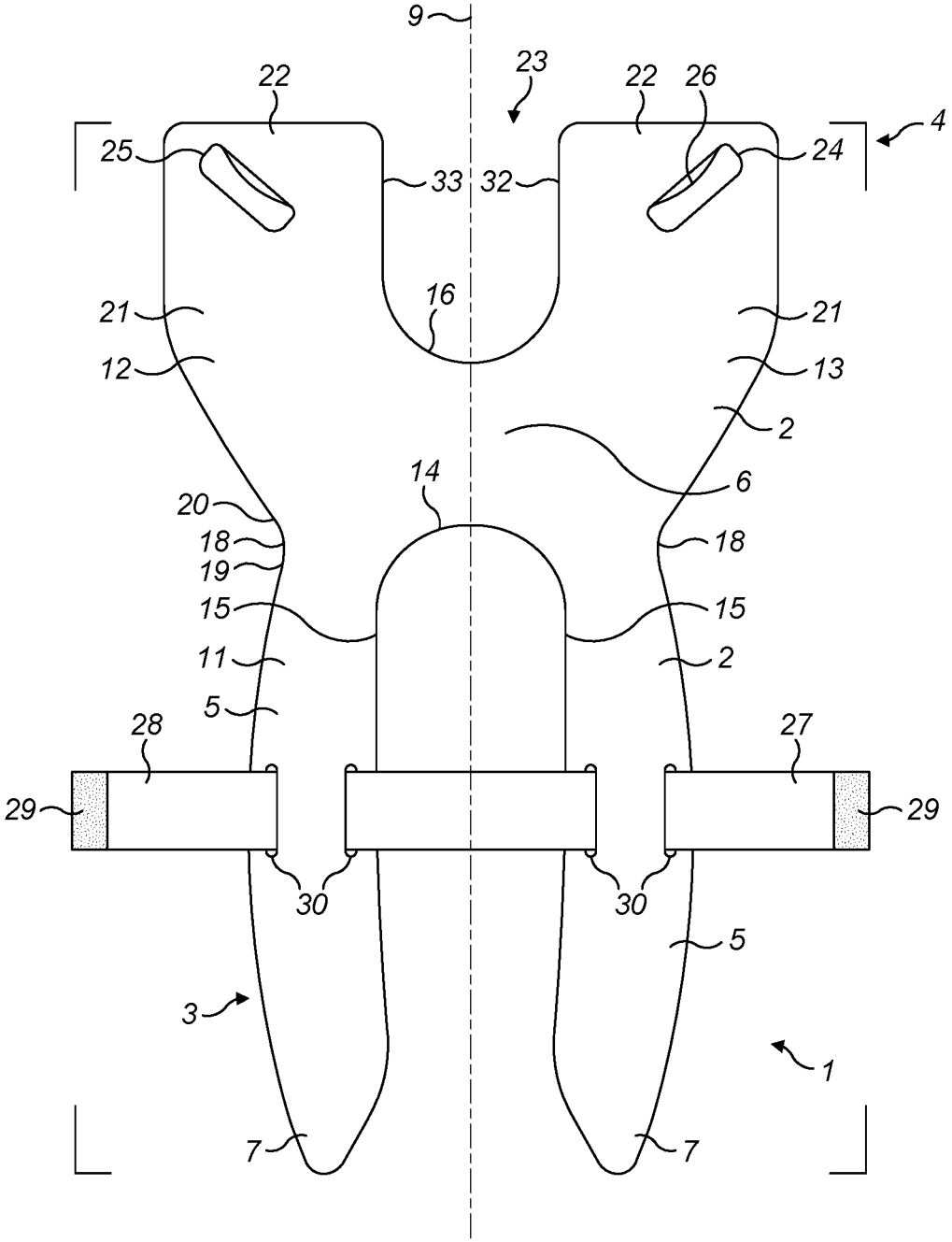
FIG. 1 is a schematic plan view of a first embodiment of an apparatus for assisting with the application of a garment, such as a tubular garment, for example a compression bandage or compression sock.

An apparatus 1 for assisting with the application of a garment is shown in schematic plan view in FIG. 1. The apparatus 1 is suitable for applying a tubular garment, and more particularly an elasticated garment, such as a compression bandage or compression sock, but the apparatus is equally suited to the application of longer ordinary type socks, such as knee-length socks. The view shown in FIG. 1 is that of the outer or upper surface 2 of the apparatus 1, with the internal or inner surface 3, which is intended to be placed against a user's limb and located underneath the upper surface 1, being hidden from view by the outer surface 2.

The outer layer or surface 2 of the apparatus 1 of FIG. 1 is manufactured from a single sheet of material and is shown lying substantially flat. In this configuration, the apparatus is substantially planar. For reference, the dimensions of an A3 sized sheet of material 4 (297 mm by 420.5 mm) are shown and the apparatus 1 may be cut out from such a sheet of material as this particular size is readily available and has been found to be particularly suitable for one or more embodiments of the present invention. Alternatively, other well-known predetermined sizes of sheets of material may be used, such as A0, A1, or A2.

The view in FIG. 1 is a plan view and so looks down onto the outer, or upper, surface 2 of the apparatus 1. The apparatus 1 comprises a single sheet of material 4, preferably acrylic or polycarbonate, which is preferably 1 mm thick and it has been found that this particular thickness provides sufficient rigidity to support a garment 8 while the garment 8 is being applied, while being sufficiently flexible so as to enable the apparatus 1 to be flexed about a central longitudinal axis 9 of the apparatus 1 in order for the apparatus 1 to be able to fit over and around a user's limb 10 and to enable the apparatus 1, particularly the garment supporting means 11, to conform to the shape of a user's limb 10, such as their leg or arm. The outer or upper layer 1 of material of the apparatus 1 is manufactured from a single sheet of material 4 and this enables the apparatus 1 to lie substantially flat when not in use so that it may be easily stowed away or that multiple apparatuses may be stacked upon each other or side-by-side. As the apparatus 1 may be readily stacked, shipping and storage costs may be reduced.

The apparatus 1 when laid flat resembles the shape of a pair of scissors or a tooth in that the apparatus comprises two substantially parallel and spaced-apart elongate arms 5 which form a part of the garment supporting means 11. The apparatus 1 may be cut from a single sheet of material 4 and is substantially symmetrical about a central longitudinal axis 9 of the apparatus 1. The elongate arms 5 are joined together by a central section of the sheet of material 4 which acts as a flexible bridge 6 and is therefore referred to herein as the flexible bridging means 6.

The flexible bridging means 6 enables the apparatus 1 to be flexed such that the two sides of the apparatus 12, 13, and thereby the two elongate arms 5, may be brought closer together by rotating the elongate arms 5 about a longitudinal axis which is substantially central to the length of the apparatus and parallel to the length or central longitudinal axis of the apparatus 9 or elongate arms 5.

The flexible bridging means 6 therefore serves as a rotation means to enable the elongate arms 5 to be rotated closer or further apart from each other, about a central longitudinal axis 9 of the apparatus 1 and, as the elongate arms are substantially parallel to the central longitudinal axis 9 of the apparatus 1, thereby about an axis which is substantially parallel to the longitudinal axis of at least one of the elongate arms 5.

The flexible bridging means 6 further provides a restorative force to bias the apparatus to the flat configuration. This restorative force increases the more the apparatus is flexed.

The inner edge 14 of the flexible bridge member 6 closest to the elongate arms 5 is substantially concave and arcuate such that the inner edge 14 joins smoothly and continuously with the inner edge of each of the elongate arms 5 such that the join between the elongate arms 5 and the flexible bridge means 6 is substantially imperceptible. Preferably, the arcuate inner edge 14 of the flexible bridge member 6 is hemispherical.

The opposite or opposing edge 16 of the flexible bridge member 6, referred to as the outer edge 16 of the flexible bridge member 6, is also substantially concave and arcuate, and is also preferably hemispherical.

The opposing concave inner and outer arcuate edges 14, 16 of the flexible bridging means provide a minimum width of the flexible bridging means substantially along the center of the flexible bridging means 6. As the flexible bridging means 6 is substantially symmetrical about the central longitudinal axis 9 of the apparatus 1, the minimum width of the flexible bridging means or member 6 is substantially in line or collinear with the central longitudinal axis 9 of the apparatus 1.

As will be understood, the minimum width of the flexible bridging means 6 provides a minimum second moment of area along the central longitudinal axis 9 of the apparatus 1 and therefore the apparatus 1 is naturally inclined to bend or flex along that axis, or that the greatest deformation of the flexible bridging means 6 occurs along the central longitudinal axis 9 of the apparatus 1 when the apparatus 1 is in the flexed configuration.

Therefore, the flexible bridging means 6 being provided with a minimum width in line with the central longitudinal axis 9 of the apparatus 1, and therefore equally spaced between the elongate arms 5, more readily enables the apparatus 1 to bend along its central longitudinal axis 9 when flexed, such as when a compressive force is applied to the two opposite longitudinal sides 12, 13 of the apparatus.

Figures 2, 2A, 2B:
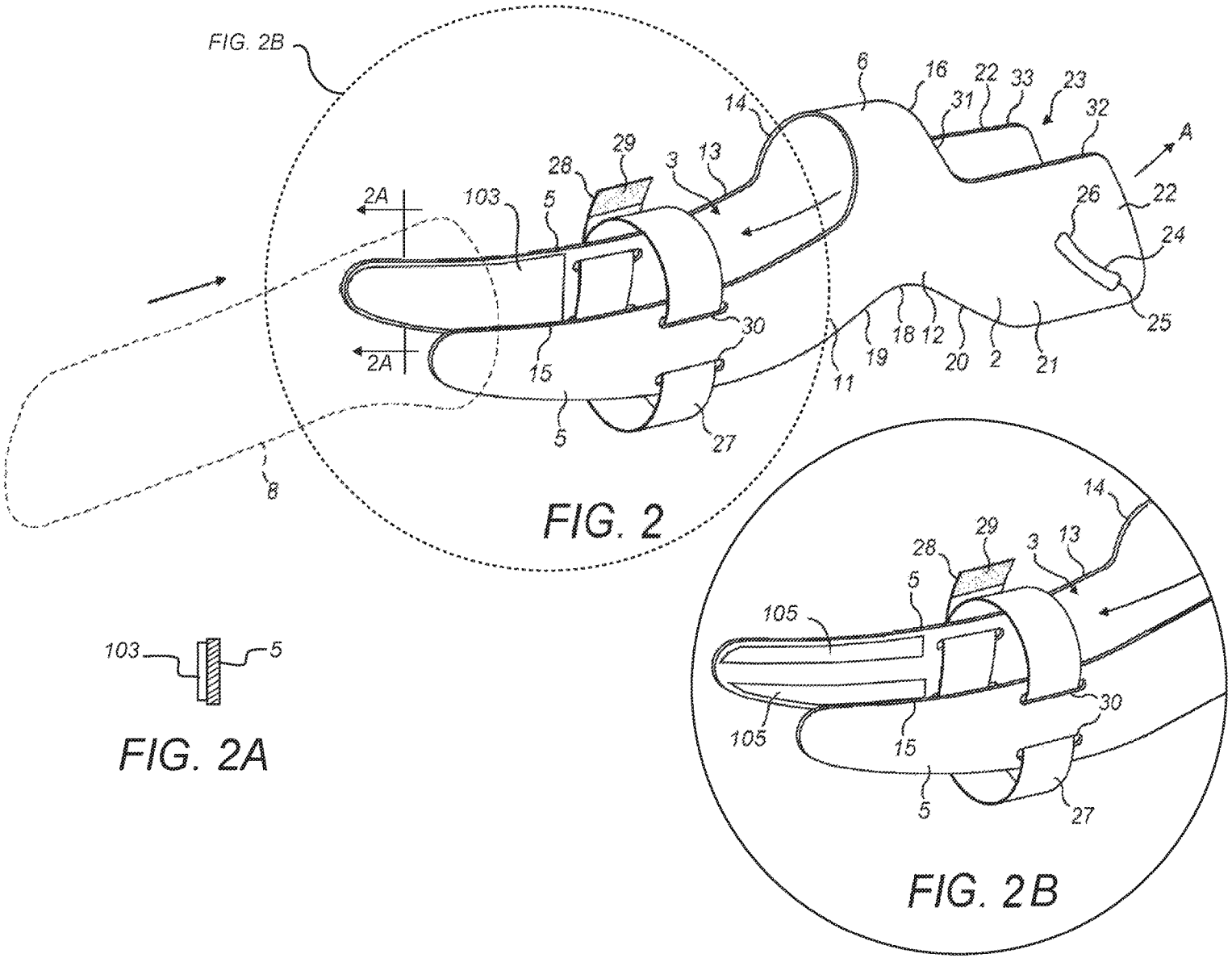
FIG. 2 is a perspective view of the embodiment of FIG. 1 in which a compression bandage is shown in dotted-lines being applied to the two elongate arms of the garment receiving means of the apparatus.
FIG. 2A is a cross section of a portion of the apparatus of FIG. 1 taken along line 2A-2A as indicated in FIG. 2.
FIG. 2B is an alternate embodiment of the apparatus of FIG. 1 depicted on a portion of FIG. 2 in which guide means are provided.

Thus, the flexible bridging means 6 more readily enables the apparatus 1 to be flexed out of plane to form a three-dimensional shape, as shown in FIG. 2, and ensures that the elongate arms 5 move together, equally and symmetrically about the central longitudinal axis 9 of the apparatus 1 when flexed so that the elongate arms 5 remain equidistant from the central longitudinal axis 9 of the apparatus, regardless of the extent to which the apparatus 1 is flexed.

The minimum width of the flexible bridge 6 additionally provides that, when the apparatus 1 is flexed, the flexible bridge 6 may assume a substantially elliptical or bowed shape in cross-section, i.e. when viewed along the longitudinal axis 9 or plane of the apparatus, in order to ensure sufficient clearance between the top of the flexible bridge 6 and a user's limb 10. Additionally, this shape ensures that a garment 8 applied to the apparatus 1 is lifted away from the user's limb 10 such that the two do not contact. The minimum thickness of the flexible bridge member 6 resulting from the opposition concave arcuate edges 14, 16 therefore assists in the application of a garment 8 to a user.

As will be appreciated, in order to further or alternatively reduce the second moment of area about the central longitudinal axis 9 of the apparatus, the sheet of material 4 of the flexible bridge member 6 could be thinner closer towards the center of the flexible bridging means 6, and thereby closer toward the central longitudinal axis of the apparatus 9.

At the opposite end to that of the flexible bridge member 6, the elongate arms 5 each comprise a substantially smooth arcuate tip 7. The elongate arms 5 are both shaped so that, when the apparatus is in the flat configuration, they curve substantially towards each other along their length, in the direction away from the flexible bridge member 6, such that, when the apparatus 1 is laid flat, the elongate arms 5 are closest to each other at their tips or ends 7. The curvature of the two elongate arms is substantially the same. The curvature of each of the elongate arms increases substantially along its length towards its tip (i.e. away from the flexible bridging means and the handles).

Although the tips or ends 7 of the elongate arms 5 point towards each other when the apparatus 1 is laid flat, when the apparatus 1 is flexed, the elongate arms 5 rotate about an axis substantially parallel to the central longitudinal axis 9 of the apparatus 1 such that they rotate out of the original flat plane of the apparatus 1 and point substantially in the same direction as each other such that they point towards the side of the apparatus 1 on which the flexible bridging member 6 is now located or, in other words, towards the top of the outer surface 2 of the flexible bridge member 6 when flexed.

The curving of the elongate arms 5 in this way ensures that a garment 8, when applied to the garment supporting means 11, spans across the tips 7 of the elongate arms 5 to the opposite end of the elongate arms 5, thus ensuring that the garment 8 is supported above the user's limb 10 all the way from the tip 7 of the elongate arms 5 to their opposite ends. The curvature of the elongate arms 5 therefore holds the garment 8 open to provide a line of clearance 17 between the garment 8 and the user's limb 10 (see FIG. 5 and FIG. 8).

Still with reference to FIG. 1, the apparatus 1 comprises garment retaining means 18 configured to receive a portion of a garment 8 and to ensure that the garment 8 remains securely on the apparatus 1 once the garment 8 has been fitted to the apparatus 1. The garment retaining 18 means comprises a substantially arcuate a V-shaped recess 18 towards the end of the elongate arms 5 near the flexible bridge member 6, wherein the opposite walls of the V-shaped recess are substantially bowed towards each other.

When the apparatus 1 is in its flexed shape, the recess 18 provides a minimum circumference around the outer surface 2 of the apparatus 1, compared the outer circumference of the adjacent outer surface 2 of the apparatus 1 on either side of the V-shaped recess 18 when the apparatus 1 is flexed.

The V-shaped recess 18 provides that the compression force of an elasticated garment 8 will tend to cause the garment 8 to naturally slide into the recess 18 and remain there while the apparatus 1 is in use. Preferably, the gradient of the walls 19, 20 of the V-shaped recess 18 generally increases towards the lowermost point of the V-shaped recess 18 so that an elasticated garment 8 will more readily slide towards the lowermost point the closer to the nadir of the V-shape (i.e. the tip of the V-shape) the garment gets. That is the walls 19, 20 of the V-shaped recess 18 are bowed towards each other.

Grasping means 21, for enabling a user to grasp or grip the apparatus 1, are provided at the opposite end of the apparatus 1 to the end with the elongate arms 5. The grasping means 21 comprises substantially flat rectangular sections 22 with rounded corners, each section 22 being spaced apart and provided on opposite sides 12, 13 of the apparatus 1, equidistant from the central longitudinal axis 9.

As with the flexible bridge member 6 and the elongate arms 5, the rectangular sections 22 of the sheet 4 of the apparatus 1 are substantially symmetrical about the central longitudinal axis 9 of the apparatus 1 and the outer perimeter edge of the apparatus 1 is rounded so that the grasping means 21 blends continuously and smoothly into the outline of the apparatus 1 when laid flat.

A gap 23 is provided between the two opposing grasping means 21 in order to increase the ease of using the apparatus 1 in that, when the apparatus 1 is in the flexed configuration, the apparatus 1 may more readily be applied to a user's leg or arm 10 without being obstructed by a part of the user's leg or arm, such as their knee or shin, or elbow or forearm.

In order to assist a user with operating the apparatus 1, each of the grasping means 21 is provided with handles 24 which comprise an aperture 25 for receiving a user's fingers. In the embodiment shown in FIG. 1, the apertures 25 are slots in the grasping means 21 which are sized to receive a user's fingers so that the fingers may pass through the apparatus 1 and may contact the underside 3 of the apparatus 1.

The apertures 25 are substantially symmetrical about the central longitudinal axis 9 of the apparatus 1 and are inclined with respect to the central longitudinal axis 9 so that a user may more comfortably hold the apparatus 1 when it is applied to their limb 10.

The apertures 25 are substantially rectangular and are ergonomically shaped with one of their longest edges 26 being curved toward the other to enable the handles 24 to be more easily grasped.

The embodiment of FIG. 1 is further provided with fastening means 27 configured to enable the apparatus 1 to be fastened to limb 10 of a user. The fastening means 27 therefore enables the apparatus 1 to remain more securely in place during the application of a garment 8. The fastening means also resists the restorative force of the flexible bridging means such that the apparatus may more readily retain its three dimensional shape in the flexed configuration after the user has stopped flexing the apparatus.

The fastening means 27 comprises a strap 28, which may comprise elastic or rubber, which is configured to be wrapped around the outer surface 2 of the apparatus 1 when flexed. In order to securely fasten the two ends of the strap 28 together, the ends of the strap 28 are provided with a hook and loop fastening system 29, with one end of the strap 28 comprising either the hook portion or the loop portion of the hook and loop fastening system and with a section of the surface of the strap comprising the complimentary portion.

Partway along the elongate arms 5, and in the embodiment shown in FIG. 1 approximately half way along the elongate arms 5, each elongate arm 5 is provided with two substantially parallel and spaced apart apertures or slots 30 configured to receive the fastening strap 28 and through which the fastening strap 28 passes in order to securely fix the fastening strap 28 to both of the elongate arms 5. Thus, the fastening system 27 enables the strap 28 to be adjusted so that the elongate arms 5 remain securely placed alongside a user's limb 10 and so that the apparatus 1 remains in the flexed configuration after the apparatus 1 has been applied to a limb 10 of the user and after the user has stopped flexing the apparatus 1 by applying a compressive force on opposite sides 12, 13 of the apparatus through handles 24. In order to minimise the friction of a garment 8 passing over the strap 28, the strap 28 may be provided with a friction-reducing film on its surface, particularly its outer or upper surface.

FIG. 2 shows the apparatus 1 in the flexed condition or configuration and further shows a sock 8, shown in dotted lines, being applied to the elongate arms 5 at the end of the apparatus 1.

The apparatus 1 assumes the flexed configuration when a user applies a compressive force to the apparatus while in the flat configuration (FIG. 1) in order to bend the apparatus out of plane to form the three dimensional shape shown in FIG. 2. Once the apparatus has been flexed and applied to the user's limb, the apparatus 1 may be caused to remain in the flexed condition by securing the fastening means 27 which, in this embodiment is located part way along the elongate arms 5, but may alternatively or additional be located anywhere along the length of the apparatus 1.

It is also particularly advantageous if the flexible bridging member 6 comprises the fastening means 27 in order to resist the strain from the flexible bridge 6 while ensuring that the two spaced apart sides 12, 13, including the elongate arms 5, remain equally spaced apart along the entire length of the apparatus 1.

This figure shows the channel 31 of the apparatus 1 in which the user's leg or arm 10 may be located.

Once the garment or sock 8 has been applied to the user's limb 10, the apparatus 1 may be removed by sliding it away from and along the user's limb 10 in substantially the direction indicated by the arrow A.

The view of FIG. 2 shows the flexible bridge member 6 when the apparatus 1 is in the flexed configuration in which it can be readily seen that the flexible bridge member 6 extends upwards and away from the user's leg or arm 10 when the apparatus 1 is flexed, that is it extends radially outwards with respect to the central longitudinal axis of apparatus 9.

The flexing of the flexible bridge member 6 in this way provides additional space or clearance for the user to manoeuvre their leg or arm 10 into the apparatus 1. Advantageously, the apparatus 1 is completely open on the underside of the apparatus 1 in the flexed condition so that a slot or channel is formed through which a user's leg or arm 10 may pass when the apparatus 1 is applied to the user. The apparatus 1 may therefore be readily applied to a user's leg or arm 10.

Figure 3:
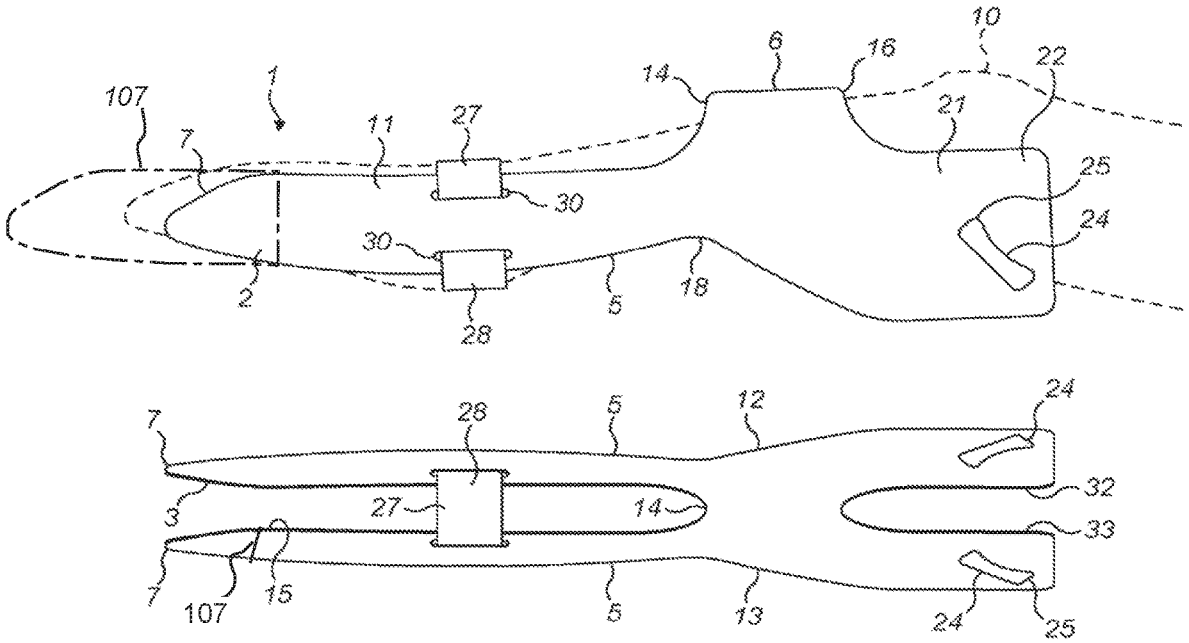
FIG. 3 is a schematic left side view and a schematic plan view of the embodiment of FIG. 1 wherein the apparatus is shown arranged around a user's leg, the user's leg being shown as a dotted line.

FIG. 3 shows a left side view and a top plan view of a second embodiment of the present invention. In the left side view, the apparatus 1 is shown in the flexed configuration applied to a user's leg 10, shown in dotted lines, immediately prior to the application of a garment 8. The flexible bridge 6 is shown extending upwards, away from the user's shin, with the elongate arm 5 located substantially either side of the user's foot.

Figure 4:
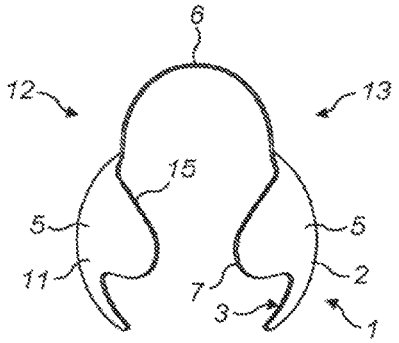
FIG. 4 is a schematic front view of the embodiment of FIG. 1.

FIG. 4 shows a front view of the embodiment of FIG. 3, viewed from the end of the apparatus 1 comprising the elongate arms 5. Notably, with the exception of the top of the flexible bridge member 6 and the gap below the apparatus 1, the elongate arms 5 and grasping means 21 are substantially circular in cross-section so as to present a substantially circular circumference to a garment 8 being applied thereto. Thus, in this embodiment, the sheet of material 4 is shaped such that the elongate arms 5, sides of the flexible bridge member 6 and the grasping means 21 are arcuate so that, when the apparatus 1 is flexed, the circumference or cross-section of the elongate arms 5, flexible bridge member 6 and grasping means 21 is substantially circular.

Although the apparatus 1 is optionally configured to return to a planar configuration when not flexed, embodiments wherein the apparatus 1 remains in the three-dimensional "flexed" configuration, and so do not assume a substantially flat or planar configuration at rest, are also envisaged. Thermosetting plastics are particularly advantageous in the manufacture of an apparatus intended to remain in the flexed configuration.

Figure 5:
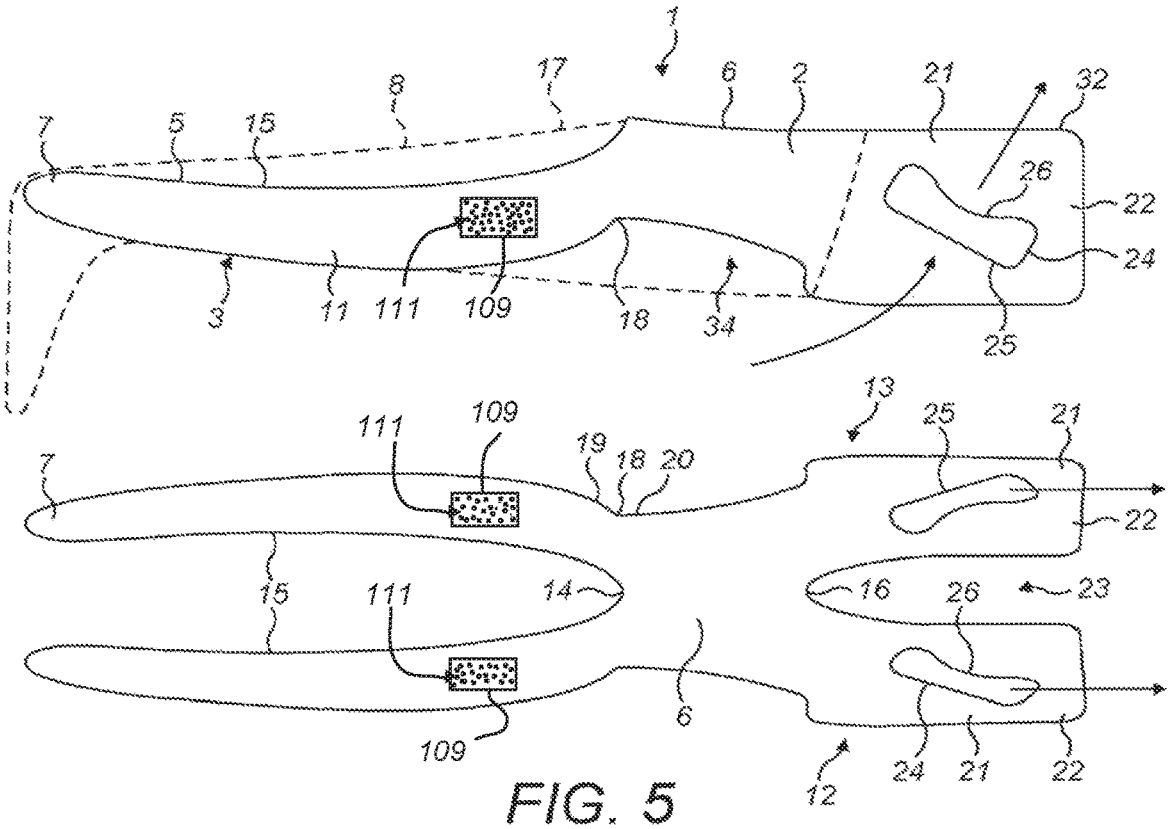
FIG. 5 is a schematic left side and top view of a second embodiment of an apparatus for assisting with the application of a garment, such as a tubular garment, for example a compression bandage or compression sock.

FIG. 5 shows a third embodiment substantially the same as that of the first and second embodiments but wherein the optional fastening means 27 is not provided and wherein the rectangular grasping sections 21 are spaced closer together such that, when the apparatus 1 is viewed from the side, the inner edges 32, 33 of the gasping means 21 are at substantially the same height as the top of the flexible bridge member 6.

Figure 6:
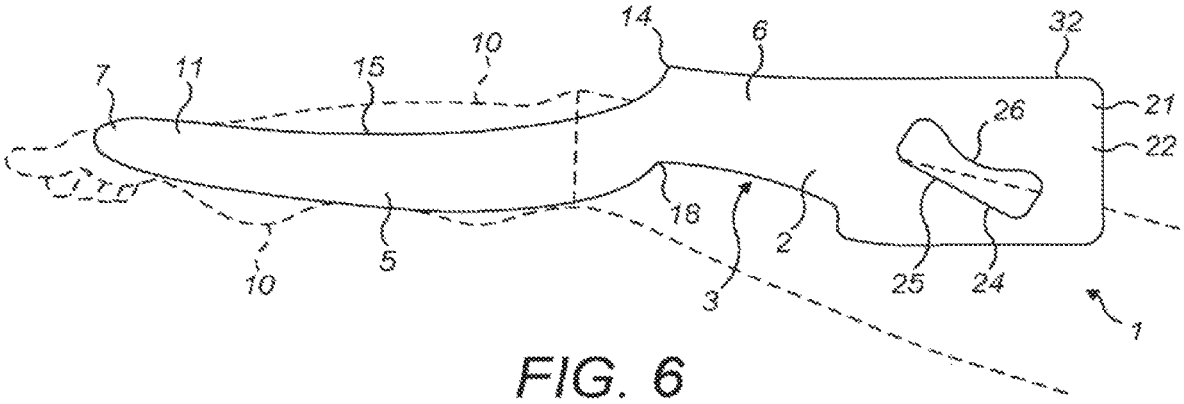
FIG. 6 is a schematic left side view of the embodiment of FIG. 5 wherein a compression bandage is shown in dotted lines and is applied to the garment supporting means of the apparatus.

As can be seen in FIG. 5 and FIG. 6, a garment or sock 8 is applied to the elongate arms 5 of the garment supporting means 11. In this figure, the garment or sock 8 has been pulled along the apparatus 1 such that the end of the garment or sock 8 has been pulled past the garment receiving recess 18 and onto the outer surface 2 of flexible bridge member 6, and as far as the grasping means 21.

When the garment or sock 8 is pulled onto the flexible bridge member 6 in this way, the clearance between the garment 8 and the user's limb 10 is increased between the front edge 14 of the flexible bridge member 6 all the way to the tips 7 of the elongate arms 5.

Additional clearance 34 below the apparatus 1 is provided when the sock 8 is pulled onto the rectangular sections 22 of the grasping means 21 because the lowest point of the grasping means 21 when the apparatus 1 is flexed is lower than the lowest point of the flexible bridging member 6.

Figure 7:
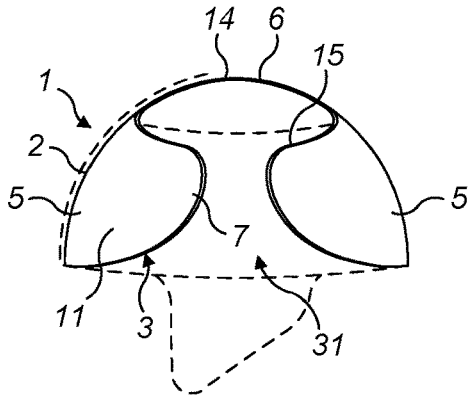
FIG. 7 is a schematic front view of the embodiment of FIG. 5 applied to a user's leg, shown in dotted lines.

FIG. 7 shows a front view of the embodiment of FIG. 5, viewed from the end of the apparatus 1 with the tips 7 of the elongate arms 5. As can been seen in this figure, in the flexed configuration, the elongate arms 5 are curved radially inwards along their length so as to be closer together towards their tips 7 than at the opposite end of the elongate arms 5. This enables different types of sock or garment to be applied to the same apparatus.

For example, the elongate arms 5 are close enough together at their tips 7 that narrow, short socks may be fitted to the apparatus 1, but far enough away at their opposite end such that stockings or full-length socks may also be used with the same apparatus 1.

Additionally, with all of the embodiments of the present invention discussed herein, the thickness of the elongate arms 5 may vary along their length in order to suit socks or bandages of different lengths and of different compression or elasticity. In this regard, the thickness of the elongate arms 5 may decrease along their length towards the end of the arms 5 comprising the tip 7.

Figure 8:
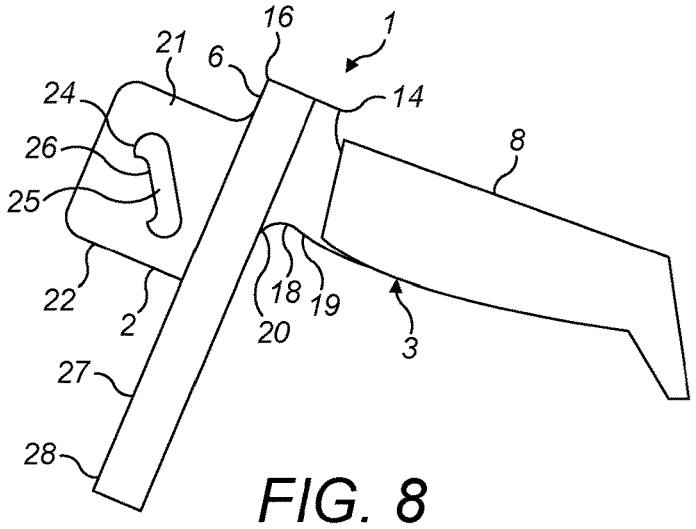
FIG. 8 is a schematic right side view of a third embodiment according to the present invention in which a garment is shown applied to the apparatus, the apparatus comprising a fastening means.

FIG. 8 shows a further embodiment of the present invention wherein a fastening means 27 in the form of a strap 28 with hook and loop fasteners 29 is attached to the flexible bridge member 6 and configured to be wrapped around a user's limb 10 in use in order to fasten the apparatus 1 to the user. In this figure, a sock 8 is shown applied to the apparatus 1.

Figure 9:
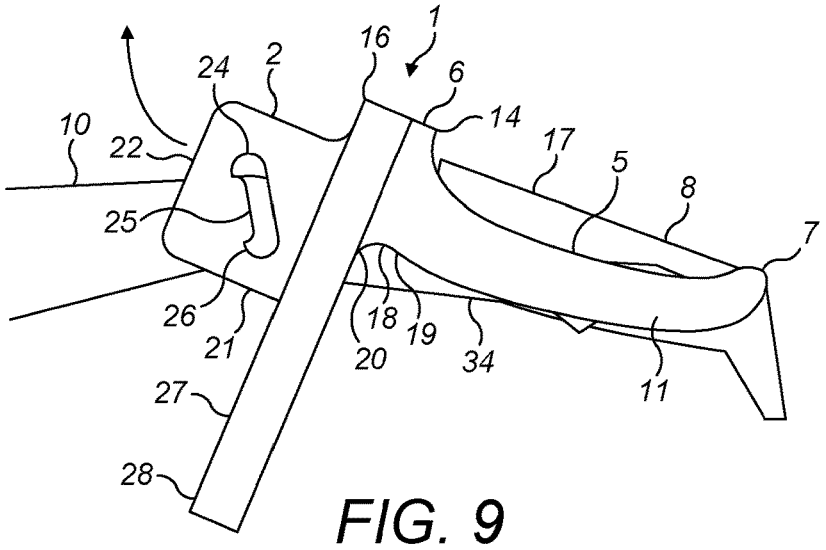
FIG. 9 is a schematic right side view of the embodiment of FIG. 8 arranged over a user's leg and after a compression bandage has been fitted to the apparatus and when the apparatus is ready for removal by the user.

FIG. 9 is a side view of the embodiment of FIG. 8, showing the apparatus 1 applied to a user's leg 10 with a sock 8 applied to the apparatus 1 and shown in cut-away. As can be seen, the curvature of the elongate arms 5 provides means for enabling the garment 8 to span across the length of the elongate arms 5 and thereby lift the garment 8 away from the user's leg 10 and provides sufficient clearance between the two so that the garment 8 may be readily applied to the apparatus 1 without the garment 8 contacting the user's leg 10 or without the garment 9 catching the user's leg 10 when the apparatus 1 is removed.

The apparatus 1 may also comprise alternative or additional garment retaining means 18 configured to retaining the garment 8 on the apparatus 1 during use. Such garment retaining means 18 may comprise a friction-increasing means 109 in order to increase friction between the garment 8 and the apparatus 1, and particularly between the garment 8 and the elongate arms 5. Such friction-increasing means may comprise friction pads located on the outer surface 2 of the apparatus 1, for example on the outer surface 2 of the elongate arms 5.

In examples wherein the foam comprises a layer, film or coating, for example a vinyl layer or coating, the friction increasing means may comprise one or more exposed areas (i.e. one or more areas of the external surface of the apparatus 1, for example of elongate arms 5) of foam to provide an additional or alternative garment retaining means. An exposed area of foam is an area of foam which does not comprise the layer, film or coating, for example a vinyl layer or coating. As vinyl coated foam, particularly gloss vinyl coated foam, may be quite smooth and may have a low coefficient of friction such that a garment may easily or readily slide or be slid along the surface of the vinyl coated areas, an exposed area of foam provides an area or portion of the apparatus, e.g. of the elongate arms 5, with increased friction (i.e. increased coefficient of friction) compared to the vinyl coated portion such that the garment 8 may engage the exposed area or areas of foam such that the garment's position on the apparatus may be maintained while a user's limb is being inserted into the apparatus 1. Once the user's limb has been properly positioned within the apparatus 1, the portion of the garment engaging the exposed foam may be removed from the exposed foam, for example by rolling the garment off of the exposed foam, enabling the garment 8 to slide or be slid along the comparatively smooth elongate arms 5 and off of the apparatus 1 and onto the user's limb, thereby applying the garment 8 to the user.

A vinyl coated high density foam is particularly advantageous as such foams are substantially tear resistant. A vinyl coating may be applied directly to the high density foam and as such vinyl coatings are particularly advantageous as an adhesive is not required to bond the low-friction layer (the vinyl coating) to the foam layer, as would be required for some other types of coating. The vinyl coating may also be provided as a gloss vinyl coating and as such provides for a particularly smooth and low-friction coating which may assist with the application of the garment 5 to the user as it may enable the garment to readily slide along the surface of the apparatus 1, even with particularly tight-fitting or highly elasticated garments 5.

The friction pads may be hook fasteners of a hook and loop type fastening system which may be adhered onto particular desirable locations, such as towards the end of the elongate arm members 5 nearest to the flexible bridge member 6, or the flexible bridge member 6 itself. The number of friction pads and the extent of the friction-increasing means provided depend on the type of sock the apparatus 1 is intended to be used with. Therefore, an apparatus for use with tighter socks will comprise more friction pads or more extensive friction-increasing means in order to further secure the garment 8 on the apparatus 1.

The friction-increasing means 109 may additionally or alternatively comprise a friction surface having a greater coefficient of friction than the surrounding surface. Such a surface may comprise roughened areas or may comprise protrusions 111 configured to stand proud of the outer surface of the apparatus and configured to engage a garment 8. Such protrusions could be shark-tooth-like or thorn-like in shape in order to more effectively engage the material, e.g. the weave or fibres, of the garment 8.

With the exception of any friction increasing means which the apparatus 1 may comprise, the outer surface 2 of the elongate arms 5 is substantially smooth so as to enable a user to readily slide a garment 8 along their length.

As will be appreciated, different sizes of apparatus 1 may be provided according to the size of the user or according to the application of the apparatus 1. Thus, a smaller apparatus 1 can be used for a child, whereas a larger apparatus can be used for an adult. Similarly, a smaller apparatus 1 would be better suited for applying a garment 8 to an arm than an apparatus for applying a garment 8 to a leg.

In order so that the same apparatus may be used for different applications or for differently sized people, length adjusting means may be provided configured to enable the length of the apparatus 1, and particularly of the elongate arms 5, to be varied according to the application or to the user. In this regard, the elongate arms 5 may each comprise an extension piece 107 attached to the end of each elongate arm 5. Optionally, the extension pieces may be detachable from the apparatus 1 so that they may be removed when they are not needed.

Although not shown in the figures, a cushioning means may be provided to ensure comfort for the user by distancing the outer surface of the apparatus 1 from to limb 10 to which the apparatus 1 is to be applied. In the above embodiments, the cushioning means 103 comprises a layer of foam or rubber attached to underside, or interior surface 3, of the apparatus 1. The foam is preferably medium density foam and the foam or rubber layer is preferably 2 to 3 mm thick. The foam may alternatively be high density foam. The foam may comprise a laminate layer on at least one of the external surfaces of the foam, for example the foam may comprise a vinyl layer or coating. The vinyl layer or coating may be a gloss vinyl layer or coating.

When the cushioning means is a layer of foam, it may also be cut, or otherwise manufactured, from a single sheet of material and it may even be made from the same template as that used for the upper layer 2.

The cushioning means ensures that the relatively stiff material, preferably acrylic or polycarbonate, of the upper layer 2 remains separated from the user's body 10, particularly from bony areas such as the elbow, knee or ankle, in order to improve comfort for the user.

In order to further reduce the friction between the user's limb 10 and the apparatus 1, a friction-reducing film may be provided on the foam or rubber layer so that the apparatus 1 may be more easily applied to and removed from the user's limb 10.

The cushioning means may be permanently attached to the underside of the apparatus 1, such as by adhesive, or may be removable, for example by the provision of hook and loop fastening patches adhered to the cushioning means and the underside 3, or internal surface, of the apparatus 1.

Although the cushioning means may take the form of a single sheet of foam substantially the same shape as the upper layer of the apparatus 1, it may also be provided as cushioning strips attached to the underside 3, or interior surface, of the apparatus 1 and may be positioned at particularly important locations, such as the ends of the elongate arms 5 in order to cushion the ankle of the user from the relatively hard outer layer 2 of the apparatus 1. The cushioning strips may be made of foam or rubber.

The cushioning strips may be straight or may be curved in order to assist with guiding the apparatus 1 around a body part 10 of the user, such as their ankle or knee, when it is being removed from the user. The cushioning strips may also be positioned in spaced-apart pairs so as to act substantially as a rail or other guiding means 105 as depicted in FIG. 2A, enabling the user's ankle or knee to be securely positioned between the pair of strips and enabling the apparatus to be slid along and guided around that part of the user's body. The path of the pair of spaced-apart strips may therefore be curved or arcuate to facilitate the upwards and along movement of the apparatus 1 required in order to remove the apparatus 1 from the user.

It is envisaged that the person skilled in the art may make various changes to the embodiments specifically described above without departing from the scope of the invention.

The invention claimed is:

1. An apparatus for assisting with the application of a garment, the apparatus comprising a garment supporting means configured to support a garment, the garment supporting means comprising two substantially parallel with respect to each other and spaced-apart, sheet-like, arcuate, elongate arms, wherein the elongate arms each have a proximal end, a distal end, and a longitudinal axis extending from the proximal end to the distal end;

wherein the apparatus is reconfigurable between a first configuration in which the elongate arms are substantially coplanar with each other and a second configuration in which the elongate arms substantially oppose each other; and further comprising a flexible bridge member of the apparatus and configured to adjoin the two elongate arms at only their proximal ends and configured to enable the elongate arms to be resiliently rotatable about an axis parallel to the longitudinal axes of the elongate arms from the first configuration to the second configuration;

wherein when the apparatus is in the first configuration, the elongate arms are configured to curve substantially toward each other such that the distal ends of the elongate arms point toward each other.

2. The apparatus of claim 1 further comprising a sheet of material wherein the sheet of material comprises the garment supporting means.

3. The apparatus of claim 2, wherein the sheet of material is substantially flat.

4. The apparatus of claim 2, wherein the sheet of material comprises the flexible bridge member.

5. The apparatus of claim 2, wherein the sheet of material comprises acrylic or polycarbonate.

6. The apparatus of claim 1, wherein the flexible bridge means member is configured such that, when the apparatus is flexed about its longitudinal axis, the bridge member extends radially outwards with respect to the longitudinal axes of the elongate arms.

7. The apparatus of claim 1, wherein the apparatus is bendable, from the first configuration to the second configuration.

8. The apparatus of claim 1, wherein the apparatus is formed from a single sheet of material.

9. The apparatus of claim 1, wherein the elongate arms and the flexible bridge member together comprise a single sheet of material.

10. The apparatus of claim 1, wherein the apparatus includes cushioning means configured to cushion a user from the garment supporting means.

11. The apparatus of claim 10, wherein the cushioning means is configured to be detachable from a further component of the garment supporting means.

12. The apparatus of claim 10, wherein the cushioning means comprises a foam layer.

13. The apparatus of claim 12, wherein the foam layer comprises a medium density foam.

14. The apparatus of claim 12, wherein the foam layer comprises a high density foam.

15. The apparatus of claim 10, wherein the cushioning means includes a friction-reducing layer or film.

16. The apparatus of claim 15, wherein the friction-reducing layer or film is a vinyl layer or film.

17. The apparatus of claim 1, further comprising apparatus guiding means configured to enable the apparatus to be guided, in use, along a limb of a user.

18. The apparatus of claim 17, wherein the apparatus guiding means comprises spaced apart guides configured to receive a portion of a user's limb and configured to enable the portion of the user's limb to be slid between the guides.

19. The apparatus of claim 1, further comprising length adjusting means configured to enable the length of at least one elongate arm to be varied.

20. The apparatus of claim 19, wherein the length adjusting means comprises an extension piece configured to extend from an end of at least one of the elongate arms.

21. The apparatus of claim 20, wherein the extension piece is detachably attachable to an end of one of the elongate arms.

22. The apparatus of claim 1, wherein the arcuate elongate arms have substantially the same curvature as each other.

23. The apparatus of claim 1, wherein the elongate arms become closer together towards the distal ends of the elongate arms.

24. The apparatus of claim 1, further comprising a garment retaining means.

25. The apparatus of claim 24, wherein the garment retaining means comprises a friction-increasing means configured, in use, to increase the friction between the garment retaining means and a garment.

26. The apparatus of claim 25, wherein the friction-increasing means comprises a friction surface having an increased coefficient of friction with respect to a surface adjacent thereto or surrounding the same.

27. The apparatus of claim 26, wherein the friction surface comprises a hooked portion of a hook and loop fastening system.

28. The apparatus of claim 24, wherein the garment retaining means includes a plurality of protrusions extending from the surface of the garment retaining means, the protrusions being configured to engage a garment.

29. The apparatus of claim 28, wherein the elongate arms include the garment retaining means.

30. The apparatus of claim 24, wherein the garment retaining means includes a garment receiving recess configured to receive a garment in use and to retain the garment.

31. The apparatus of claim 30, wherein the garment receiving recess is configured such that, when the apparatus is in the second configuration, the garment receiving recess provides a reduced circumference of an outer surface of the apparatus with respect to a circumference of an adjacent surface of the apparatus.

32. The apparatus of claim 30, wherein the garment receiving recess is substantially V-shaped.

33. The apparatus of claim 1, including a fastening means for fastening the apparatus against a limb of the user.

34. The apparatus of claim 33, wherein the fastening means comprises a strap.

35. The apparatus of claim 34, wherein the strap includes a hook and loop fastener.

36. The apparatus of claim 1, wherein the apparatus includes two spaced apart handles, located on either side of the apparatus.

37. The apparatus of claim 36, wherein each handle comprises an aperture configured to receive fingers of the user.

38. The apparatus of claim 1, wherein at least one of the elongate arms, with the apparatus in the second configuration, is substantially arcuate such that it is curved about a lateral axis thereof.

39. The apparatus of claim 1, which comprises a tubular garment application tool.

40. The apparatus of claim 1, which comprises a compression bandage application tool.

41. The apparatus of claim 1, wherein the elongate arms define an elongate void space between them from the flexible bridge member adjoining the proximal ends to the distal ends.

42. A method of manufacturing an apparatus for assisting with the application of a garment, comprising the step of manufacturing an apparatus according to claim 1 from a single sheet of material.

* * * * *